United States Patent [19]

Manström

[11] Patent Number: 4,480,954

[45] Date of Patent: Nov. 6, 1984

[54] BOTTOM DUMP ARRANGEMENT

[75] Inventor: Hilding Månström, Luleå, Sweden

[73] Assignee: Luossavaara-Kiirunavaara AB, Stockholm, Sweden

[21] Appl. No.: 293,204

[22] PCT Filed: Dec. 18, 1980

[86] PCT No.: PCT/SE80/00341

§ 371 Date: Aug. 13, 1981

§ 102(e) Date: Aug. 13, 1981

[87] PCT Pub. No.: WO81/01819

PCT Pub. Date: Jul. 9, 1981

[30] Foreign Application Priority Data

Dec. 20, 1979 [SE] Sweden ..... 7910528

[51] Int. Cl.[3] ..... B65G 67/30; B61D 7/32; B61D 9/14; B61D 7/22

[52] U.S. Cl. ..... 414/383; 105/241.2; 105/250; 105/284; 414/387

[58] Field of Search ..... 105/241.1, 241.2, 239, 105/250, 268, 364, 280, 281, 284; 414/376, 377, 378, 383, 387, 388

[56] References Cited

U.S. PATENT DOCUMENTS

| | | | |
|---|---|---|---|
| 28,969 | 7/1860 | Cooley | 414/383 |
| 3,169,491 | 2/1965 | Darlington et al. | 105/424 |
| 3,650,221 | 3/1972 | Nagy | 105/240 |
| 3,717,109 | 2/1973 | Miller | 105/250 |
| 4,207,020 | 6/1980 | Schuller | 105/250 |
| 4,222,334 | 9/1980 | Peterson | 105/250 |
| 4,250,814 | 2/1981 | Stark et al. | 105/280 |

FOREIGN PATENT DOCUMENTS

| | | | |
|---|---|---|---|
| 384854 | 11/1923 | Fed. Rep. of Germany . | |
| 2902354 | 8/1979 | Fed. Rep. of Germany | 105/377 |
| 1001602 | 10/1951 | France | 105/241 |

*Primary Examiner*—Robert B. Reeves
*Assistant Examiner*—David F. Hubbuch
*Attorney, Agent, or Firm*—Cushman, Darby & Cushman

[57] ABSTRACT

A bottom dump arrangement attached to a body which provides a goods-holding space, the body resting on an undercarriage and including at least one pair of adjacent doors having remote edges, the doors being pivotally attached at their remote edges for swinging movement in a curved path transverse to the body and perpendicular to the remote edges, the free edges of the doors facing toward each other abutting each other in closed position of the doors, the arrangement also including guide paths that cooperate with the body to lift the body relative to the undercarriage, a linkage assembly pivotally connected between the doors and the body for permitting the body, when lifted by the guide paths, to become inclined to the pivotal axes for the doors in a vertical plane, which is parallel to the pivotal axes of the doors and perpendicular to the plane that the undercarriage rests on.

8 Claims, 22 Drawing Figures

BOTTOM DUMP ARRANGEMENT

This invention relates to a bottom dump arrangement intended to be attached to a goods-holding space resting on an undercarriage. The goods-holding space preferably is a wagon body of an ore wagon, and the bottom dump arrangement comprises at least one pair of doors, which are at their remote edges pivotally attached for pivotal movement in a plane perpendicular to said edges. In the closed state of the doors, the door edges facing each other abut each other sealingly.

In a previously known bottom dump arrangement of the aforesaid type the doors are connected to the body via a simple joint. For the dumping operation the body must be lifted from the undercarriage in parallel therewith. The lifting can be effected either in that the wagon is moved past guide paths, which must be two in number and be located on both sides of the wagon, or by means of lift arms, which lift the body of the wagon when the wagon is standing still.

The system of double guide paths is relatively complicated and, therefore, expensive. The system comprising lift arms implies that the wagon has to be stopped for dumping, which lowers the dumping speed.

The principal object of the present invention is to provide a bottom dump arrangement of the kind referred to above, at which arrangement so-called rolling dumping can be carried out by means of simple guide paths on both sides of the wagon, because the body is not required to be lifted off the undercarriage in parallel therewith.

Figure 1:
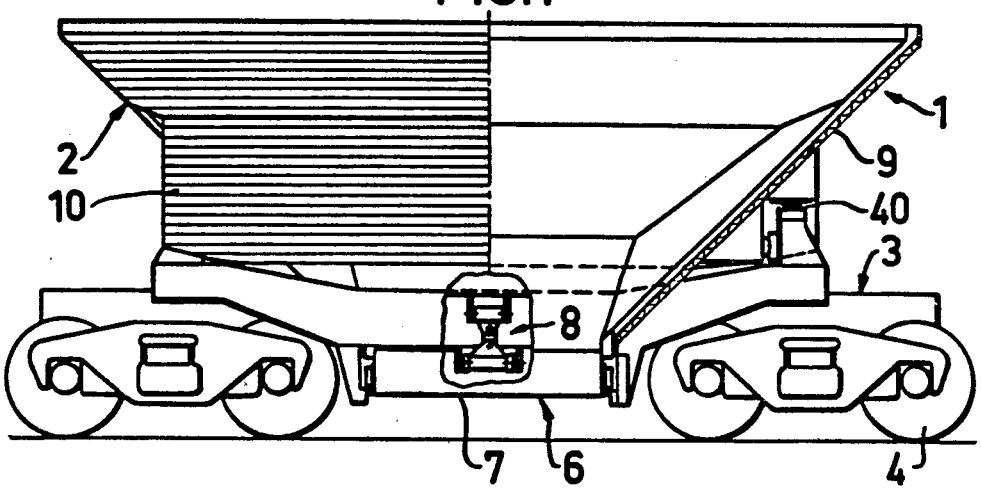
Figure 2:
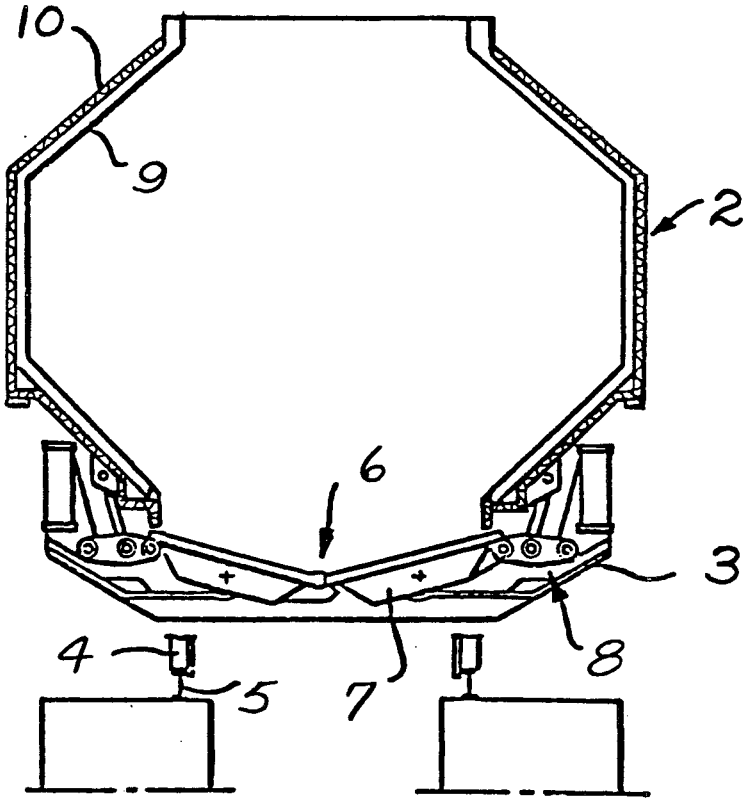
Figure 3:
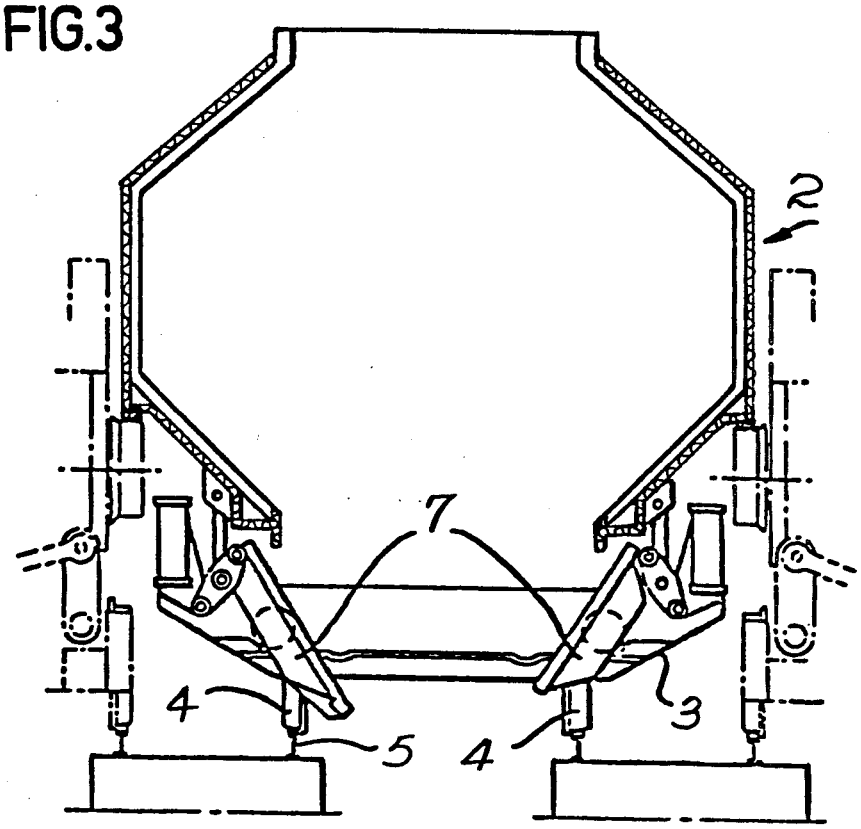
Figure 4:
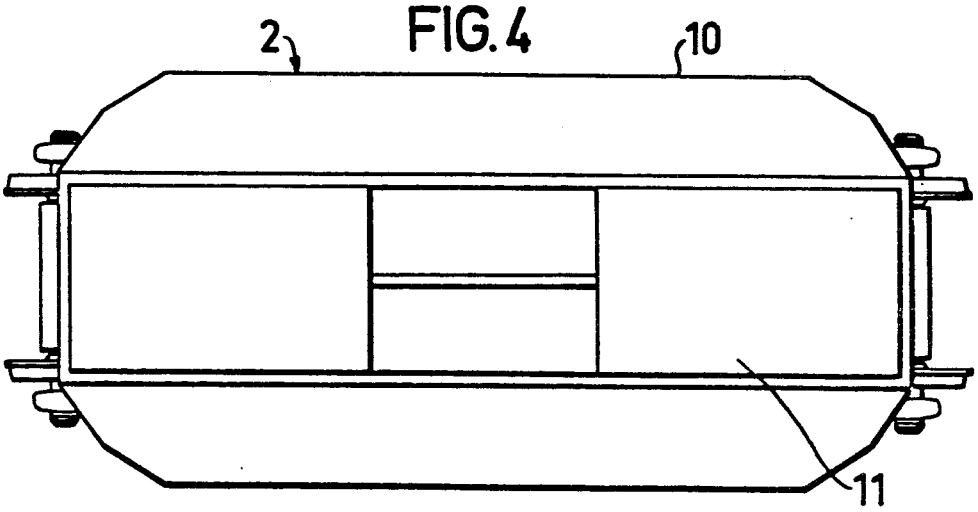
Figure 6:
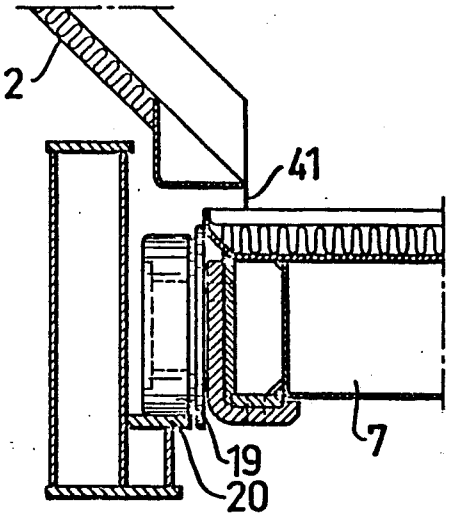
Figure 7:
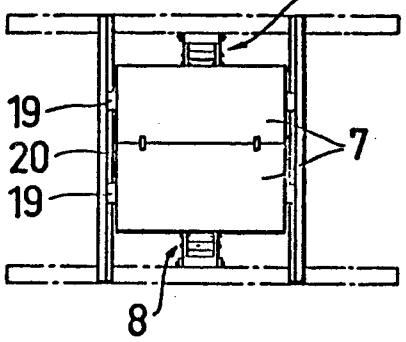
Figure 8:
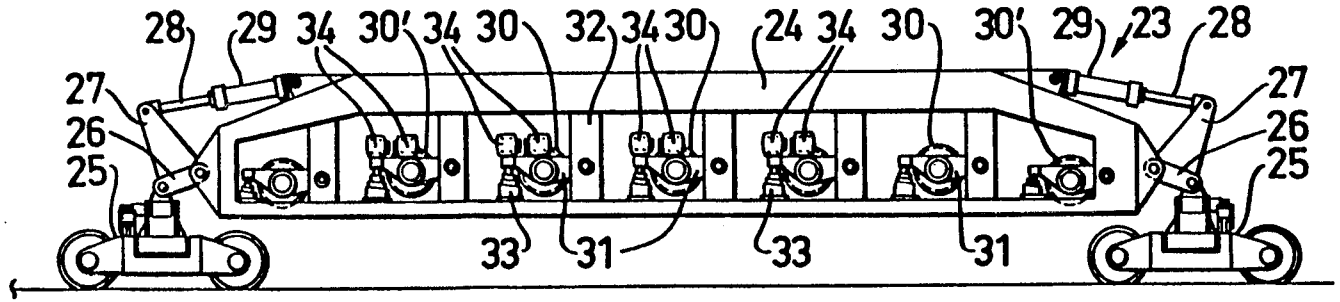
Figure 9:
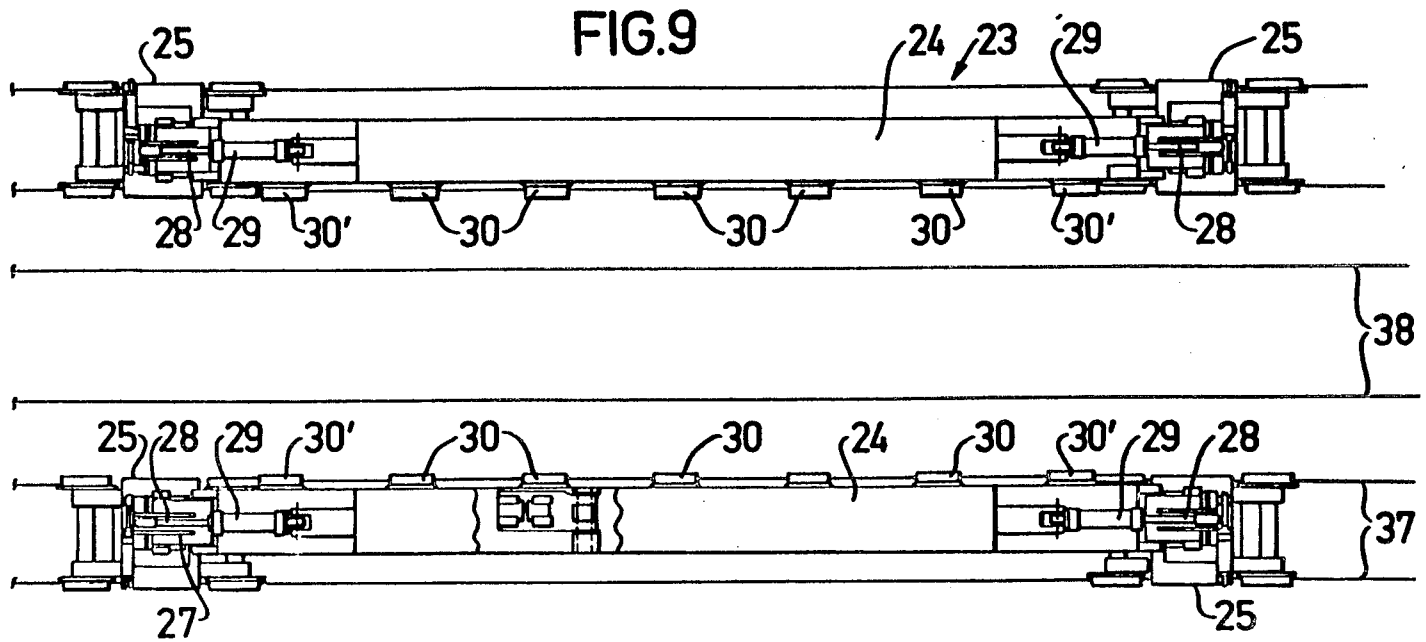
Figure 12B:
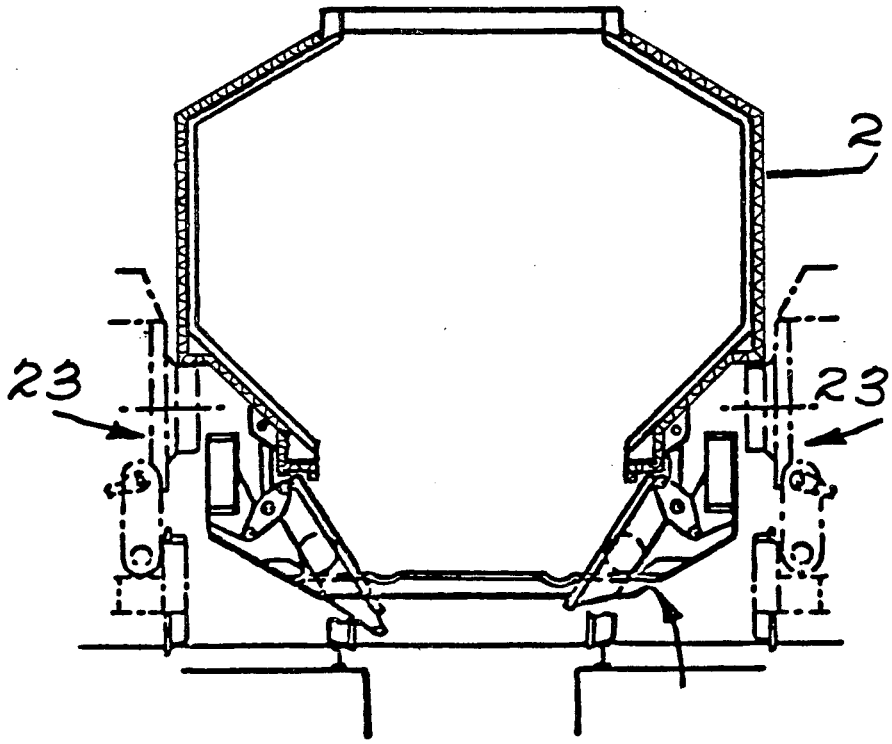
Figure 8A:
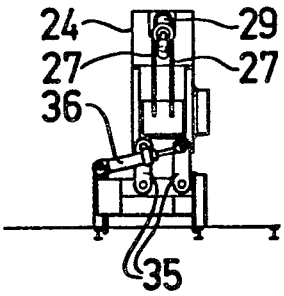
Figures 13A, 13B:
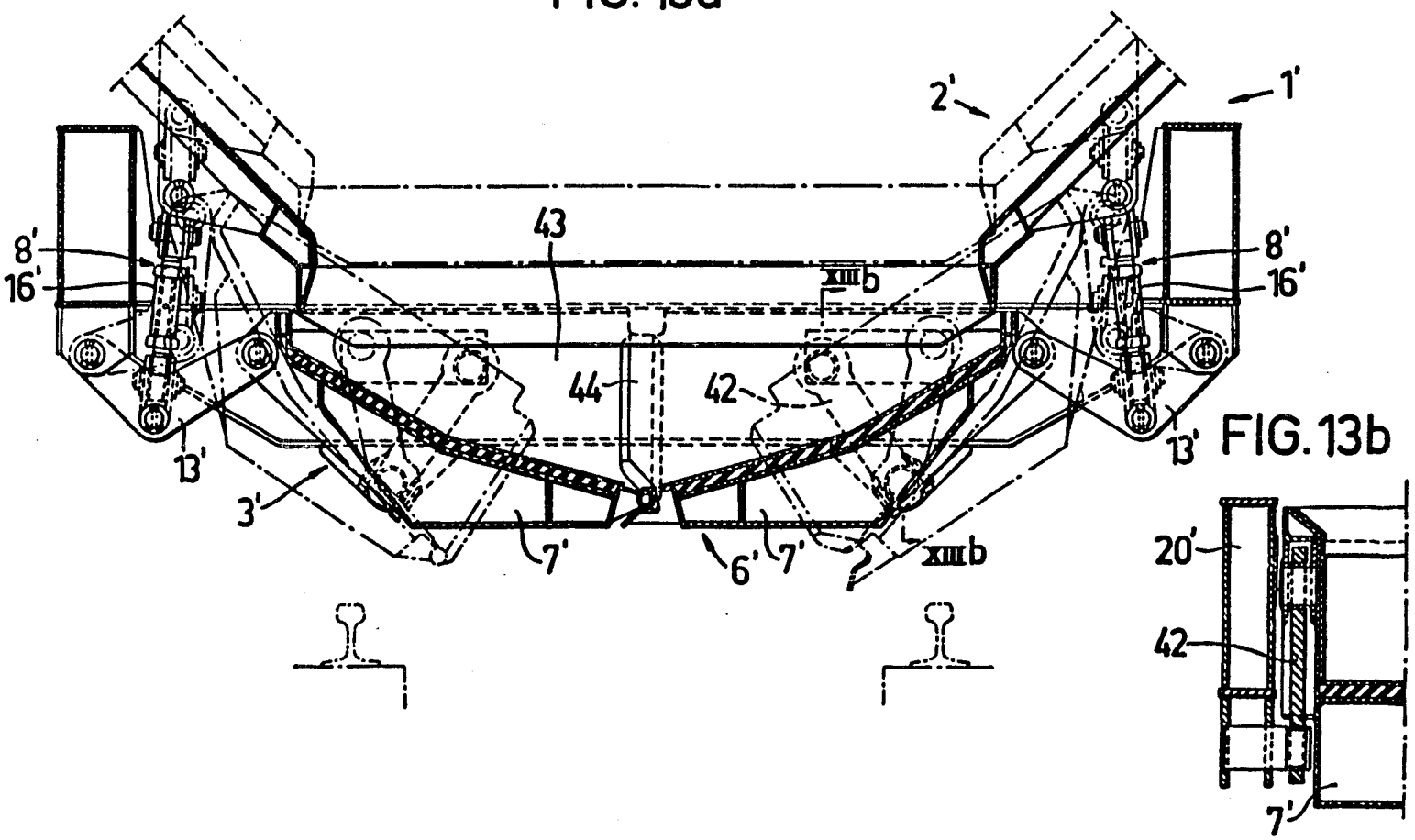
Figure 14:
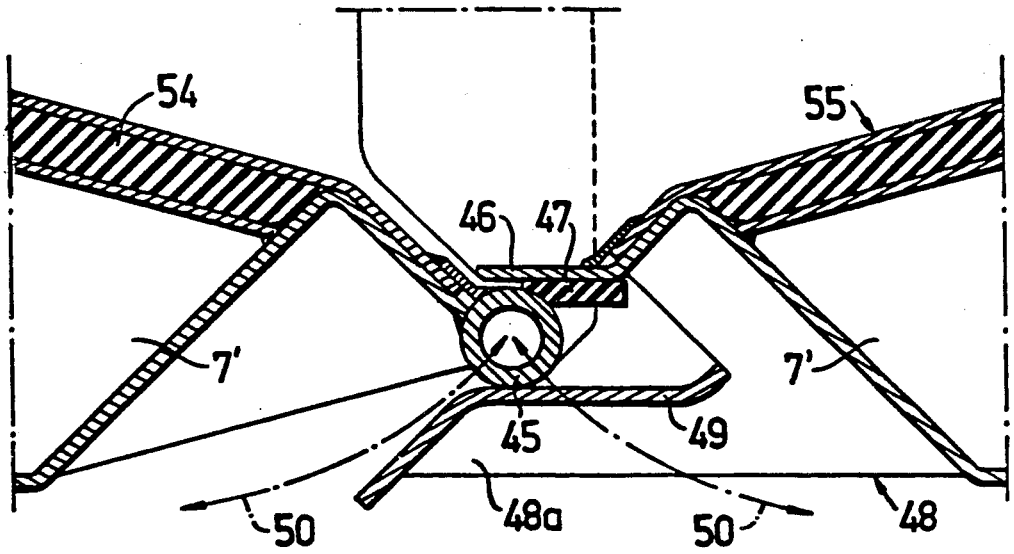
Figure 15:
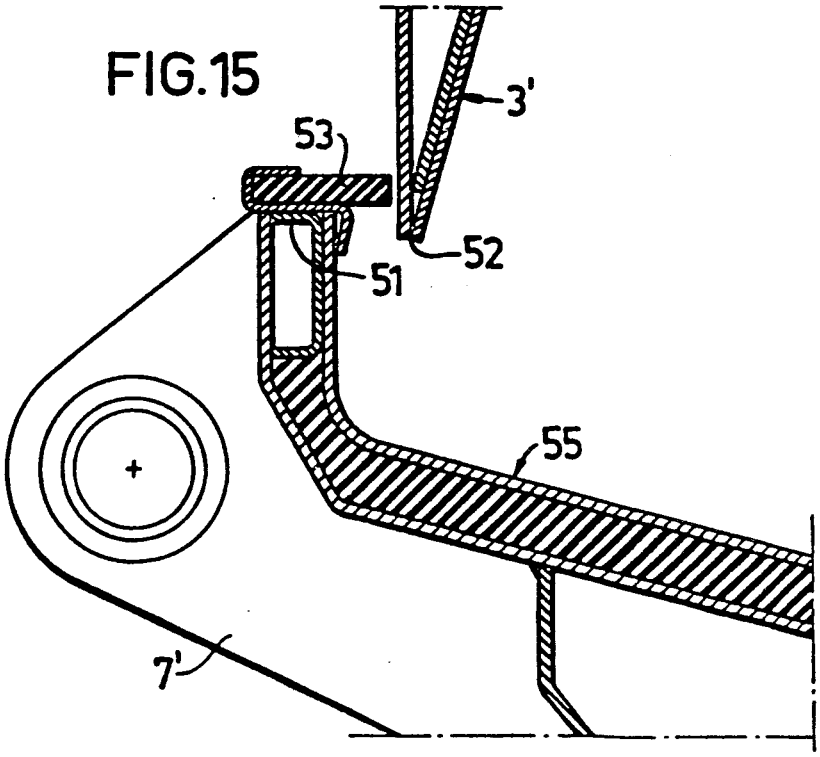

In the following an embodiment of the invention is described with references to the accompanying drawings, in which:

FIG. 1 is a partially sectional lateral view of a wagon equipped with the bottom dump arrangement according to the invention, FIG. 2 is a vertical section through the wagon shown in FIG. 1, FIG. 3 is a vertical section through a wagon shown in FIG. 1, the bottom doors thereof being open, FIG. 4 is a plan view of the wagon shown in FIG. 1, FIGS. 5, 5*a*, 5*b* show in detail the linkage supporting the doors, FIG. 6 shows in detail how the supporting wheels of the doors abut guide bars in the undercarriage, FIG. 7 is a plan view of the doors, FIGS. 8, 8*a* are lateral and longitudinal views, respectively, of a guide path, FIG. 9 is a plan view of a pair of guide paths, FIGS. 10*a*, 10*b*, 11*a*, 11*b*, 12*a*, 12*b* show the wagon in different phases of dumping, FIGS. 13*a*, 13*b* show details of another embodiment of the invention, FIG. 14 shows a sealing detail between the doors, and FIG. 15 shows the connection of the upper door edge to the body.

The wagon 1 shown in FIGS. 1–3 comprises a body 2 and an undercarriage 3 supporting the body. In the embodiment shown the undercarriage comprises wheels 4 abutting rails 5.

The body 2 is downwardly provided with a bottom dump arrangement 6 comprising doors 7, which are carried by supporting wheels 19 and controlled by a linkage 8.

FIGS. 1 and 2 the body 2 rests on the undercarriage 3, and its doors 7 are closed. In FIG. 3 the body is lifted relative to the undercarriage 3, and the doors 7 are open. The bottom dump arrangement is described in greater detail below.

The body 2 is provided with an insulating layer 9, in the outside of which a cover layer 10, for example of corrugated sheet metal, is provided.

Upwardly on the body 2 in FIG. 4 filler doors 11 are located. These doors are not a part of the main invention and, therefore, are not shown in detail.

The bottom dump arrangement 6, as already mentioned, comprises doors 7, which are connected to the body 2 and undercarriage 3 via a linkage 8. See FIGS. 5, 5*a*, 5*b*.

The linkage 8 comprises a yoke 12 with a bottom portion 12*a* formed as a sleeve and with two legs 13, which extend from the bottom portion 12*a* and at their ends remote therefrom are attached pivotally to the doors 7.

The doors 7 and the yoke 12 are pivotal in a curved path transverse to the body and perpendicular to the longitudinal direction of the wagon 1.

Figure 5:
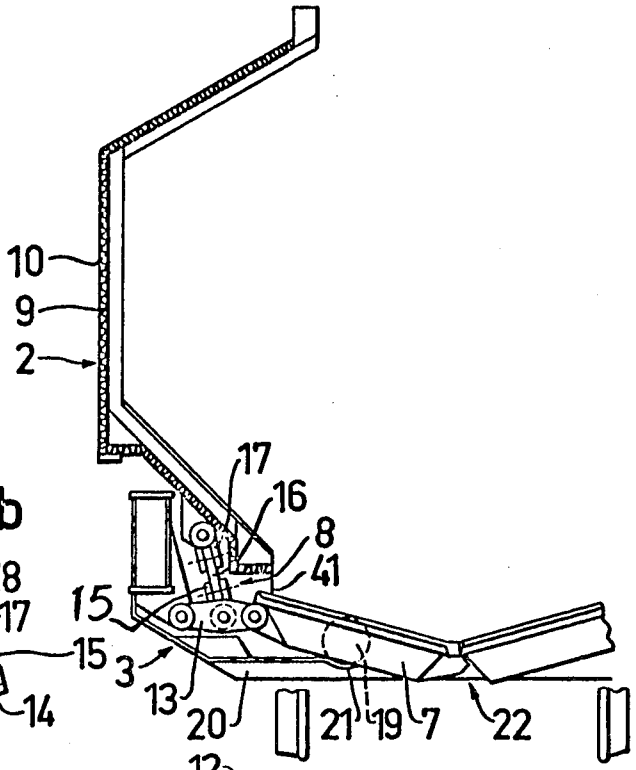
Figure 5B:
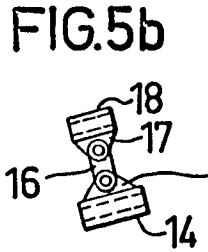
Figure 5A:
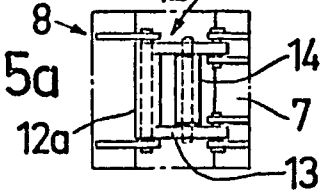

Between the legs 13 a sleeve 14 is rotatably mounted, and on the sleeve two fastening lugs 15 are attached, see especially FIG. 5*b*, between which one end of a link 16 is pivotally attached. The other end of the link 16 is pivotally attached between two fastening lugs 17 on an additional sleeve 18, which in turn is mounted rotatably at the body 2.

The sleeves 14 and 18 are rotatable in the same plane as the doors 7 and the yoke 12. The link 16 is pivotal in a plane perpendicular to the pivotal plane of the doors 7 and yokes 12.

As appears from FIGS. 5, 6, 7, each door 7 is provided with a rotatably mounted supporting wheel 19 on the two sides, which are in parallel with the pivotal plane of the doors 7. The supporting wheels 19 rest on substantially horizontal guide bars 20 in the undercarriage.

As is shown most clearly in FIG. 5, the supporting wheels 19 rest in depressions 21 in the guide bars 20 when the doors are closed.

In the closed state of the doors 7 their meeting ends form a goods labyrinth 22, which renders it more difficult for the enclosed goods to leak out through the joint between the doors 7.

For dumping the wagon 1, the body 2 is lifted off its undercarriage 3, by moving the wagon 1 past two guide paths 23 arranged on both sides of the wagon 1. The guide paths are shown especially in FIGS. 8–10.

As appears from FIGS. 8–10, the guide paths 23 comprise a beam 24, which at its two ends are connected to wheeled stands 25 via links 26. Said links 26 are at their ends pivotally attached to the beam 24 and, respectively, stand 25. Two parallel upward directed metal sheets 27 extend from each link 26, between which sheets the projecting piston rod end 28 of a pressure-medium cylinder 29 is pivotally attached. At its opposite end the hydraulic cylinder 29 is attached to the beam 24.

On the beam 24 a number of supporting wheels 30 are mounted, which are carried rotatably on arms 31 comprised in the beam 24.

The other end of the arms 31 are supported on springs 33.

Two unbalanced motors 34 are arranged upon the central arms 31 and cause these arms to carry out vibration movements substantially in a vertical direction.

As appears from FIG. 8, the two outermost supporting wheels 30' are located on a lower level than the remaining supporting wheels 30. The reason for this is that the body 2 shall be lifted by degrees from one end. This will be explained in more detail below.

It appears especially from FIG. 8*a* how the links 26 are connected to the stand 25 via double pairs of parallel tie rods 35, which are pivotally attached to the links 26 as well as to the stand 25. The beams 24 thereby can be moved transversely to their longitudinal direction substantially in parallel with the base. This movement is controlled by means of pressure-medium cylinders 36 at both ends of the beam 24.

In FIG. 9 a pair of guide paths 23 are shown where the supporting wheels 30 are facing toward each other. The Figure also shows schematically the rails 37 for the stand 25 of the guide paths 23. Between said rails 37 the rails 38 are shown, on which the wagon to be emptied as advanced.

In FIGS. 10*a*–12*b* the wagon 1 is shown in different phases of dumping.

Figure 10A:
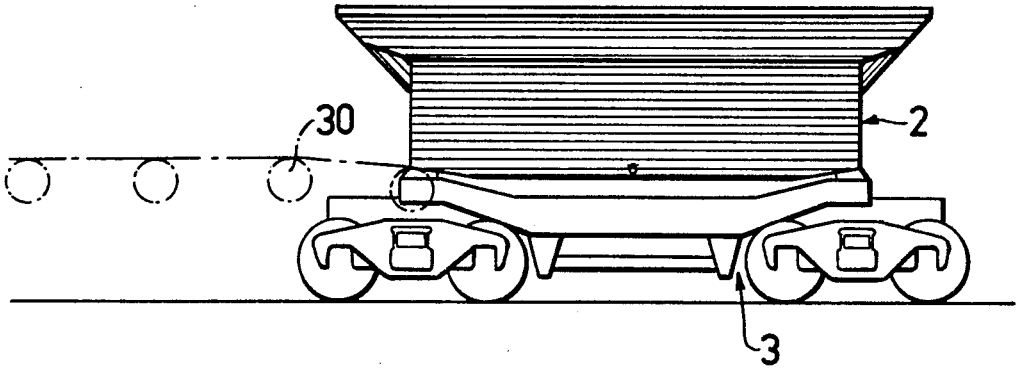
Figure 10B:
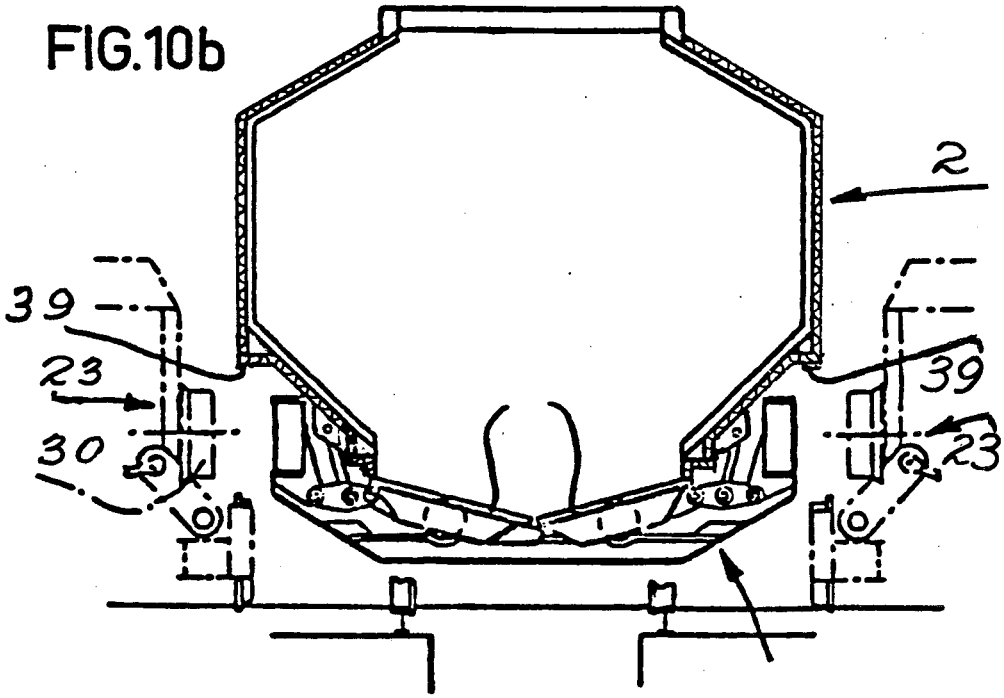

FIGS. 10*a* and 10*b* show the wagon 1 when it is just on its way up onto the guide paths 23, which by means of the pressure-medium cylinders 29 and 36 have been so adjusted in their position relative to the wagon 1, that supporting bars 39 of the body 2 are located directly above supporting wheels 30.

Figure 11A:
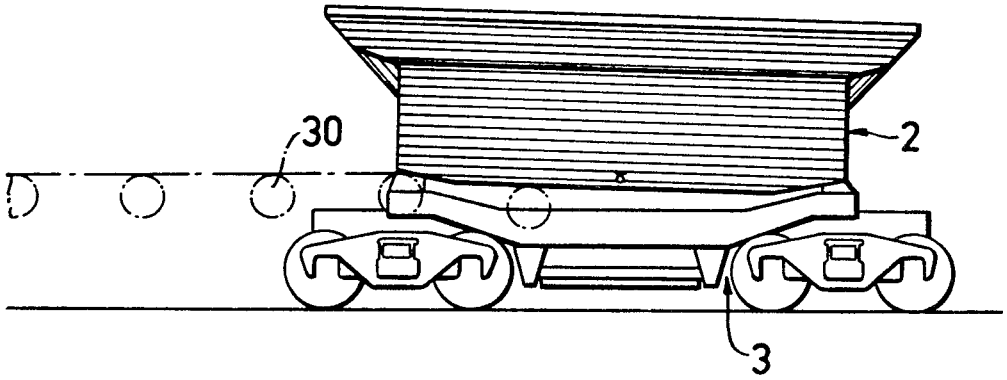
Figure 12A:
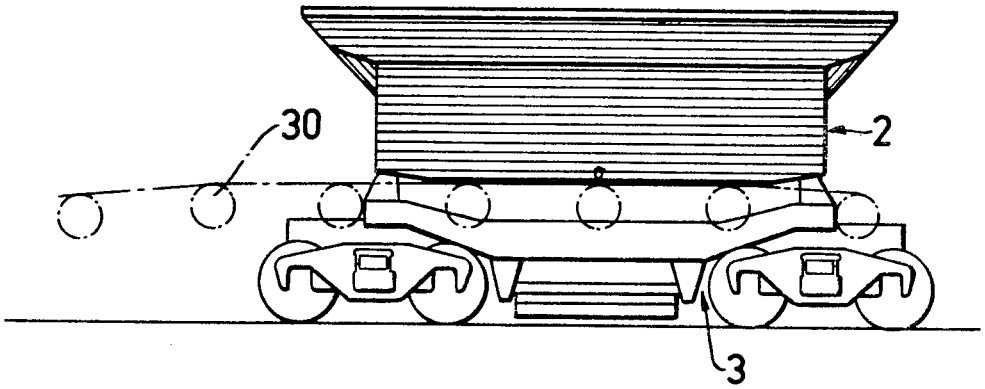

Upon continued relative movement between the wagon 1 and the guide paths 23, the left-hand end in FIG. 11*a* of the body 2 will be lifted by the wheels, whereby the left-hand end of the body 2 rotates about a supporting bearing 40, see FIG. 1, along a circular arc. The upper attachment point of the link 26 thereby also rotates about the bearing 40 along a circular arc, which results in the link 16 being positioned inclined in the longitudinal direction of the body 2.

Figure 11B:
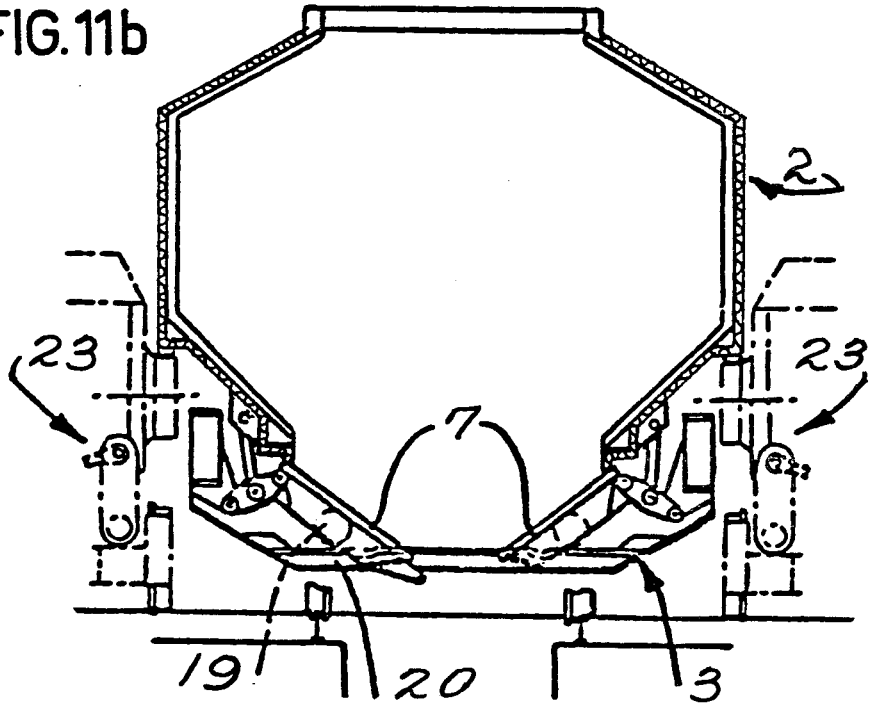

Due to the lifting of the upper attachment point of the link 16, of course, also the lower attachment point is lifted, whereby the legs 13 of the yoke 12 will be pivoted upwards about their attachment point in the undercarriage 3, see FIG. 11*b*.

Upon this pivotal movement of the legs 13 also the attachment point of the doors 7 is lifted, see FIG. 11*b*, whereby the supporting wheels 19 of the doors 7 will roll along the guide bar 20.

Continued movement of the wagon 1 and guide paths 23 relative to each other in the longitudinal direction of the wagon 1 means, that the entire body 2 is moved up on the supporting wheels 30, whereby additional lifting of the attachment points of the link 16 and of the attachment point of the door 7 to the legs 13 is effected. Thereby the position shown in FIGS. 12*a* and 12*b* has been assumed, in which the doors 7 are fully open. Thereby the inclined position of the link 16 ends.

The door 7 being attached to the legs 13 at a point located farther away from the rotation center of the yoke 12 than the link 16, the attachment point of the door 7 is lifted to a greater height than the lower attachment point of the link 16.

This is of great advantage, because the body 2 relatively seen must not be lifted much for causing the attachment point of the door 7 to the legs 13 to assume the position, in which the door 7 is fully open, see FIG. 12*b*.

In the initial phase of the lifting of the body 2 relative to the undercarriage 3, see FIG. 11*a*, the upper attachment point of the link 16 is moved slightly to the left in FIG. 11*a* because this point moves along an arc. The lower attachment point of the link 16, however, is not moved to the left in FIG. 11*a*, because the door 7 is substantially fixed in this direction by the attachment of the link 16 and the abutment of the supporting wheels 19 to the guide bars 20, see FIG. 6. The relative movement between the upper and lower attachment point for the link 16 is taken up, in that the link 16 assumes an inclined position, as mentioned above. Thereby the mutual forces between the body 2 and the door 7 in the longitudinal direction of the wagon 1 are very small.

The dumping starts when the wagon 1 has assumed the position shown in FIGS. 11*a* and 11*b*, i.e. as soon as the doors 7 start to open. The dumping continues and is completed when the wagon 1 has assumed the position shown in FIGS. 12*a* and 12*b*, in which position the doors 7 are fully open.

Due to the fact that the emptying of the wagon 1 by the method described above proceeds very rapidly, the wagon 1 normally need not be stopped, but can move along the guide paths 23 relatively slowly, with so-called rolling dumping. Preferably, the dumping can be carried out over an underpass.

When the wagon 1 is being moved down from the guide paths 23, the doors 7 are closed in a way inverted relative to the opening of the doors.

In an alternative dumping method the guide paths can be imagined to be moved relative to a stopped wagon.

It is also possible to lift the entire wagon 1 in parallel to the base, for example by means of the guide paths 23. Thereby the beam 24 with the supporting wheels 30 is lifted by actuation of the pressure-medium cylinders 29. The bottom dumping arrangement according to the invention, however, is designed especially for being capable to manage emptying when the body 2 is inclined to the base and, therefore, said variant should not be of great practical value.

As appears most clearly from FIGS. 5 and 6, the body 2 has a downward directed edge 41, which acts as a so-called goods labyrinth, i.e. the goods due to its internal friction cannot leak out past the edge 41.

It also is to be mentioned that the doors 7 in open position form inclined planes guiding the goods down between the rails.

In the embodiments shown in FIGS. 13*a* and 13*b*, the doors 7' are guided in a way different from that of the afore-described embodiment.

As appears from FIGS. 13*a* and 13*b*, the opening and closing movements of the doors 7' are guided by links 42, the upper ends of which are pivotally connected to the doors 7', while the lower ends are pivotally connected to a transverse guide beam 20' on the undercarriage 3'.

The linkage 8' for the suspension of the doors 7' on the body 2' has in principle a design corresponding to that of the linkage 8 in the embodiment described above.

As regards the legs 13' in FIG. 13*a*, their design is slightly different from that of the legs shown in FIG. 5. The legs 13' between their attachment points are bent to the undercarriage and, respectively, to the doors. The legs 13' thereby are given V-shape.

The reason for this modified design of the legs 13' is to ensure that the moment acting from the linkages 8' on the doors 7' has correct direction, because otherwise the doors 7' could be locked in open position, as indicated by the dash-dotted position in FIG. 13*a*.

The doors 7′ in FIG. 13*a* have a design which also is slightly modified compared with that of the doors 7 in, for example, FIG. 5.

As appears from FIG. 13*a*, the doors 7′ are provided with end walls 43 located in the pivoting plane, and the free ends 44 of said walls overlap each other in closed position of the doors 7′.

The sealing between the free edges of the doors 7′ shown in FIG. 14 comprises a pipe 45 attached to one door 7′ and extending along the free end thereof. To the other door 7′ an upper guide sheet 46 is attached in parallel with said pipe 45, and on the lower surface of said sheet a rubber strip 47 is fastened, for example by glueing.

Holding sheets 48 located at a certain c/c-distance in the pivotal plane of the door 7′ extend from the zone for the upper guide sheet 46.

Said sheets 48 have V-shape, and one leg 48*a* thereof extends all the way below the pipe 45 in closed position of the doors 7′. On the upper side of the leg 48*a* a guide sheet 49 is attached in parallel with the guide sheet 46. The opening and closing movements of the free ends of the doors 7′ are indicated by dash-dotted arrows in FIG. 14.

When the doors 7′ are being closed, the pipe 45 is moved in between the guide sheets 46 and 49, whereby the pipe abuts the rubber strip 47. The two guide sheets 46 and 49 form together with the pipe 45 a mechanism for taking up vertical forces acting on the doors 7′.

When goods leak out between the pipe 45 and strip 47, it remains on the lower guide sheet 49. This means that at a certain goods level and angle of repose leakage between the pipe 45 and strip 47 does not continue.

When the doors 7′ are being closed, it may happen that goods are left on the lower guide sheet 49. By action of the pipe 45 a certain amount of the goods will be moved out over the righthand edge in FIG. 14 of the guide sheet 49 between the holding sheets 48.

In FIG. 15 is shown how the upper portion of the door 7′ joins the body 3′.

As appears from FIG. 15, the upper edge 51 of the door 7′ is located on a higher level than the lower edge 52 of the body 3′. This implies that the internal friction of the goods prevents leakage between the door 7 and the body 3′.

When the goods have a tendency of moving, as may be the case at a certain grain size composition and moisture content, a complementary elastic sealing 53 may be placed above the upper edge of the door 7′.

The doors 7′ are coated on their inner surface with a rubber layer 54, on which a thin layer 55 of a special rubber with very low surface friction is attached.

The invention is not restricted to the embodiments described above, but can freely be varied within the scope of the attached claims.

I claim:

1. A bottom dump arrangement attached to a body which provides a goods-holding space, said body resting on an undercarriage and comprising at least one pair of adjacent doors having remote edges and free edges, said doors being pivotally attached to a linkage means at their remote edges for swinging movement in a curved path transverse to said body and perpendicular to said remote edges, the free edges of the doors facing toward each other abutting each other in a closed position of the doors, the arrangement also comprising means forming guide paths that cooperate with the body to lift the body relative to the undercarriage to thereby move the doors to an open position; characterized in that said linkage means is pivotally connected between the undercarriage, the doors and the body for permitting the body, when lifted by the guide paths, to become inclined to the pivotal axes of the doors in a vertical plane, as the doors move to said open position, said plane being parallel to said pivotal axes of the doors and perpendicular to the plane that the undercarriage rests on.

2. An arrangement as in claim 1 wherein the linkage means comprises a link having an upper end carried by the body for pivotal movement in both a first direction transverse to the body and in a second direction perpendicular to said first direction, the lower end of the link carrying the door and being pivotal relative to the door in said first direction and perpendicular to said first direction.

3. An arrangement as in claim 2 wherein the linkage comprises a yoke attached pivotally at the undercarriage for swinging movement about a pivotal axis of the yoke and having legs which are pivotal in said first direction, the lower end of the link being pivotally attached to the legs, and the door associated with the linkage also being pivotally attached to the legs at a longer distance from the pivotal axis of the yoke than the attachment of the link.

4. An arrangement as in claim 1 wherein the door further comprises side edges provided with supporting wheels, which abut guide bars in the undercarriage.

5. An arrangement as in claim 1 wherein each door comprises side edges, said arrangement further including a guide link pivotally attached at one end to a door side edge, the other end of the link being pivotally attached to the undercarriage.

6. An arrangment as in claim 1 wherein one door is provided at its free edge with a pipe extending along the edge, while the other door at its free edge is provided with two guide metal sheets, which extend along the edge and are separated in vertical direction in closed position of the doors for taking up between themselves the pipe.

7. An arrangement as in claim 6 wherein a sealing strip is attached on the lower surface of the upper guide sheeet.

8. An arrangement as in claim 6 wherein the lower guide sheet is bent downward at its edge facing outward.

* * * * *